US012698020B2

(12) United States Patent
Weber

(10) Patent No.: US 12,698,020 B2
(45) Date of Patent: Aug. 4, 2026

(54) METHOD FOR THE CONFIGURATION OF CONTROL SOFTWARE IN A RAIL VEHICLE

(71) Applicant: Siemens Mobility GmbH, Munich (DE)

(72) Inventor: Matthias Alexander Weber, Uttenreuth (DE)

(73) Assignee: Siemens Mobility GmbH, Munich (DE)

( * ) Notice: Subject to any disclaimer, the term of this patent is extended or adjusted under 35 U.S.C. 154(b) by 481 days.

(21) Appl. No.: 18/548,140

(22) PCT Filed: Feb. 17, 2022

(86) PCT No.: PCT/EP2022/053919
§ 371 (c)(1),
(2) Date: Aug. 28, 2023

(87) PCT Pub. No.: WO2022/179928
PCT Pub. Date: Sep. 1, 2022

(65) Prior Publication Data

US 2024/0140507 A1 May 2, 2024

(30) Foreign Application Priority Data

Feb. 26, 2021 (DE) ..... 10 2021 201 834.3

(51) Int. Cl.
*B61L 27/57* (2022.01)
*B61L 27/70* (2022.01)

(52) U.S. Cl.
CPC ..... *B61L 27/57* (2022.01); *B61L 27/70* (2022.01)

(58) Field of Classification Search
CPC ..... G06F 9/445; G06F 9/4451; B61L 27/70; B61L 27/57
(Continued)

(56) References Cited

U.S. PATENT DOCUMENTS 4,532,509 A * 7/1985 Pulverenti ..... H04Q 9/00 340/3.31
8,494,695 B2 * 7/2013 Cooper ..... B61L 15/0018 701/19
(Continued)

FOREIGN PATENT DOCUMENTS

CN 109996702 A 7/2019
CN 112041212 A 12/2020
(Continued)

OTHER PUBLICATIONS

Serban et al., A Standard Driven Software Architecture for Fully Autonomous Vehicles, 2020, p. 20-33, vol. 1, No. 1, Atlantis Press, DOI: https://doi.org/10.2991/jase.d.200212.001; ISSN: 2589-2258.
(Continued)

*Primary Examiner* — S. Joseph Morano
*Assistant Examiner* — Maxwell L Meshaka
(74) *Attorney, Agent, or Firm* — Laurence A. Greenberg; Werner H. Stemer; Ralph E. Locher

(57) ABSTRACT

A method configures control software in a rail vehicle. The control software, which is designated for a multitude of rail vehicles, implements basic functions required for basic operation of the rail vehicles. The control software additionally implements optional functions required to execute client-specific requests. The specifications, combinations and functional sequences of the basic functions and optional functions are tested, validated and approved before the functions are implemented in the rail vehicles, whereupon the basic functions and optional functions are implemented in rail vehicles. In a selected rail vehicle, at least one optional function is activated or deactivated using a switching parameter that is individually allocated to the optional function. The switching parameter required therefor is established outside the rail vehicle and is then transmitted to the
(Continued)

selected rail vehicle. The activated optional function is allocated a specified operating period.

20 Claims, 4 Drawing Sheets

(58) Field of Classification Search
USPC ..... 701/20, 19
See application file for complete search history.

(56) References Cited

U.S. PATENT DOCUMENTS

| | | | | |
|---|---|---|---|---|
| 8,600,591 | B2 * | 12/2013 | Weber | G01B 21/22 246/126 |
| 8,924,050 | B2 * | 12/2014 | Katsuta | B61L 27/30 701/19 |
| 9,600,266 | B2 | 3/2017 | Molin et al. | |
| 10,402,184 | B2 | 9/2019 | Rockwell et al. | |
| 10,699,497 | B2 * | 6/2020 | Maier | H04W 4/44 |
| 10,752,269 | B2 * | 8/2020 | Govindappa | B61L 15/0081 |
| 10,933,895 | B2 * | 3/2021 | Setiawan | B61L 27/57 |
| 11,325,625 | B2 * | 5/2022 | Weiner | B61L 27/57 |
| 11,590,993 | B2 * | 2/2023 | Hammer | B61L 25/025 |
| 11,866,077 | B2 * | 1/2024 | Bailey | B61L 23/00 |
| 11,952,025 | B2 * | 4/2024 | Weber | B61L 27/16 |
| 12,145,638 | B2 * | 11/2024 | Weber | B61L 15/0081 |
| 12,157,509 | B2 * | 12/2024 | Vujanic | B61L 27/20 |
| 12,189,825 | B2 * | 1/2025 | Weber | G06F 11/1004 |
| 12,233,925 | B2 * | 2/2025 | Weber | B61L 27/57 |
| 12,515,721 | B2 * | 1/2026 | Karunaratne | B61L 15/0054 |
| 2006/0265235 | A1 | 11/2006 | Schuchardt et al. | |
| 2008/0154452 | A1 * | 6/2008 | Kapp | G08G 1/123 701/123 |
| 2012/0072055 | A1 | 3/2012 | Barlsen et al. | |
| 2012/0239230 | A1 * | 9/2012 | Weber | B61C 17/12 701/19 |
| 2013/0024054 | A1 * | 1/2013 | Katsuta | B61L 27/30 701/19 |
| 2018/0257683 | A1 * | 9/2018 | Govindappa | B61L 27/57 |
| 2019/0126957 | A1 * | 5/2019 | Schaefer-Enkeler | B61L 25/025 |
| 2019/0322231 | A1 | 10/2019 | Möller et al. | |
| 2020/0043250 | A1 * | 2/2020 | Maier | G06F 9/4451 |
| 2020/0044868 | A1 | 2/2020 | Vakulenko et al. | |
| 2020/0079403 | A1 * | 3/2020 | Setiawan | B61L 15/0018 |
| 2020/0231193 | A1 * | 7/2020 | Chen | G01N 21/8851 |
| 2021/0139041 | A1 | 5/2021 | Blumentritt et al. | |
| 2021/0284208 | A1 * | 9/2021 | Hammer | B61L 15/009 |
| 2022/0009535 | A1 * | 1/2022 | Weiner | G06T 19/20 |
| 2022/0032980 | A1 * | 2/2022 | Bailey | B61L 23/06 |
| 2022/0348242 | A1 * | 11/2022 | Vujanic | B61L 27/20 |
| 2023/0058071 | A1 * | 2/2023 | Weber | G06F 11/1004 |
| 2023/0069564 | A1 * | 3/2023 | Weber | G06F 21/44 |
| 2023/0150559 | A1 * | 5/2023 | Ghaly | B61L 21/06 701/19 |
| 2024/0034375 | A1 * | 2/2024 | Weber | B61L 27/57 |
| 2024/0043056 | A1 * | 2/2024 | Weber | B61L 15/0058 |
| 2024/0140507 | A1 * | 5/2024 | Weber | G06F 9/4451 |
| 2024/0246587 | A1 * | 7/2024 | Karunaratne | B61L 15/0054 |

FOREIGN PATENT DOCUMENTS

| | | | | |
|---|---|---|---|---|
| DE | 102004049297 | A1 | 4/2006 | |
| DE | 102005034713 | A1 | 2/2007 | |
| DE | 102006052048 | A1 | 5/2008 | |
| DE | 102009022362 | A1 | 11/2010 | |
| DE | 112012007197 | T5 | 8/2015 | |
| DE | 102015107189 | A1 | 11/2015 | |
| DE | 102017009725 | A1 | 3/2018 | |
| DE | 102017212109 | A1 | 1/2019 | |
| WO | WO-2024132415 | A1 * | 6/2024 | B61G 7/14 |
| WO | WO-2025002681 | A1 * | 1/2025 | B61L 27/20 |

OTHER PUBLICATIONS

ZHAO Jian et al., Research on Switching of Intelligent Suspension Module and Algorithm of Underlying Controller, vol. 35, No. 8, 2021, p. 16-24, Journal of Chongqing University of Technology (Natural Science), China.

* cited by examiner

METHOD FOR THE CONFIGURATION OF CONTROL SOFTWARE IN A RAIL VEHICLE

FIELD AND BACKGROUND OF THE INVENTION

The invention relates to a method for configuring control software in a rail vehicle which is preferably already in operation.

The behavior of a rail vehicle is determined using vehicle software or control software. This has been specially developed for a rail vehicle type and is comprehensibly referred to, tested and approved as a software release for this rail vehicle type.

The software is installed on the rail vehicle before or during delivery of the latter and, upon delivery to a customer, is a fixed part of the rail vehicle.

Modifications or adaptations of the software which are desired by the customer require cost-intensive redevelopment or supplementation of the software with subsequent renewed testing and approval together with activation of the software in the customer's rail vehicle.

Accordingly modified vehicle or control software is "installed" on the respective rail vehicle after approval in situ and with the aid of service personnel and is installed in the corresponding programmable components.

Depending on the extent of the software modification, a so-called non-regression test must be carried out in a suitable test infrastructure after startup.

This method for modifying software is time-consuming, personnel-intensive and cost-intensive.

SUMMARY OF THE INVENTION

Therefore, the object of the present invention is to specify an improved method for adapting or configuring vehicle or control software in a rail vehicle.

This object is achieved by means of the features of the independent claims. Advantageous developments are specified in the dependent claims.

The invention relates to a method for configuring vehicle software or control software in a rail vehicle and to a rail vehicle having control software.

According to the invention, in addition to basic functions, further functions are additionally included in the software, which further functions can be optionally activated and/or deactivated and can be used to address customer-specific requirements or a customer-specific requirements profile in a manner specific to the individual vehicle.

In this case, the basic functions describe the software components, for example functions, which are needed for the basic operation of the rail vehicle and relate to the drive and its control, relate to the brakes and their control, etc.

In this case, the optional functions describe functions which can be selected and influenced even after delivery of the rail vehicle according to customer requirements or the customer-specific requirements profile. These are, for example, an activatable and deactivatable function which relates to an operating mode "Washing journey of the rail vehicle" or enables and addresses this operating mode, which enables or relates to an adjustment or specification of a maximum speed of the rail vehicle, which enables or relates to unlocking of specific increases in the performance of the rail vehicle, which enables or relates to unlocking of a driver assistance system, etc.

The embodiments, combinations and functional sequences of the basic functions and the optional functions are tested, validated and approved before implementation in the rail vehicle by the manufacturer or by appointed entities.

The important factor in this context is that the basic functions and the optional functions are approved in a manner specific to the vehicle type and individual vehicle, whereas the optional functions can be additionally activated and/or deactivated in a manner specific to the individual vehicle.

The optional functions are activated and/or deactivated by means of individually assigned parameters and, if necessary, their sequence or result is influenced by means of parameters that have been set.

These parameters are referred to below as switching parameters and are in the form of value parameters or parameter fields.

An assigned optional function is activated and/or deactivated with the aid of a value parameter, whereas, in addition to activating and/or deactivating an assigned optional function, its internal sequence is additionally influenced with the aid of a parameter field.

The activated optional function is subject to a predetermined usage period, upon the expiry of which the optional function is deactivated using an associated switching parameter or upon the expiry of which values of an associated optional function are set to predetermined (basic) values.

This software is therefore (re)set to a predetermined or previous state after expiry of the usage period.

In one preferred development, a starting date and/or an end date is/are assigned to the optional function in order to define the usage period.

Exclusively assigning a starting date makes it possible to use the associated optional function without restriction, that is to say permanently, as of the starting date.

Exclusively assigning an end date makes it possible to use the associated optional function immediately until the end date is reached.

Assigning a starting date and an end date makes it possible to use the associated optional function in a predetermined period.

In one advantageous development, a warning message is displayed to a rail vehicle operator or to a rail vehicle fleet manager or to a rail vehicle manufacturer etc. before expiry of the usage period in order to alert them to the imminent expiry of the usage period.

In one preferred development, an initial display or possibly a repetition frequency of the display of the warning message is specifically set.

In one advantageous development, permanent activation of an optional function is adopted into an original state of the control software, which is preferably stored by the rail vehicle in question for the purpose of maintaining safety.

In one advantageous development, each time the software is restarted on a control device or control devices of the rail vehicle, a check is carried out in order to determine whether there is a warning message for an optional function.

In one advantageous development, the warning message for an optional function causes the formation of identical warning messages for further optional functions. This prevents foreseeable deactivation of an optional function from having undesirable effects on other optional functions or on the entire control software.

Accordingly, a standard warning message is formed for all optional functions and is preferably stored as a configuration component of the rail vehicle.

In one advantageous development, a list of all optional functions, together with the assigned usage period of a selected rail vehicle, can be retrieved in a remotely controlled manner. This is carried out, for example, using a web server or an Internet browser.

In one advantageous development, the contents of the switching parameters are selected or determined by the manufacturer or the sales department of the rail vehicle. This enables intelligent fleet management in which selected rail vehicles are adapted to specific tasks according to customer specifications or according to the specification of a customer-specific requirements profile.

In one advantageous development, the switching parameters are determined using software-supported tools which allow the sales staff, for example, to select permissible switching parameters for corresponding functions, to fill them as a switching parameter set and to store them.

In one advantageous development, the switching parameters are stored in the form of a file which can be directly processed by control devices of the rail vehicle.

In one advantageous development, the file containing the switching parameters is encrypted in a manner specific to the individual vehicle in order to prevent unauthorized manipulations and to prevent copying of the file.

In one advantageous development, the file containing the switching parameters is transmitted via a communication channel for implementation in the rail vehicle.

The transmission is either directed to a service engineer who receives the file via email or via a cloud-based data transmission, for example, or the file transmission is directed directly to the affected rail vehicle which receives the file and whose control devices then preferably automatically implement the file.

In one preferred development, the file containing the switching parameters is transmitted in encrypted form in order to prevent falsifications, transmission errors and/or security attacks. A public key method, for example, is used for this purpose.

In one advantageous development, the file containing the switching parameters is buffered on a computer of the rail vehicle. This is used to document the status of the software and forms a fallback solution that is used to increase vehicle safety.

In one advantageous development, the entire control technology of a rail vehicle in question, which control technology comprises a plurality of control devices for parameterization, is addressed and/or influenced using the file. Precisely one file containing switching parameters is then created for each rail vehicle and is used in the rail vehicle, the contents of which file are distributed among the associated control devices. This minimizes necessary handling effort.

In one advantageous development, during restarting or starting up ("booting"), the control devices inquire, at a central entity of the rail vehicle or a landside control station, whether there are new switching parameters for the associated rail vehicle.

In one advantageous development, this inquiry is coordinated with the aid of a changeover manager in order to prevent uncoordinated activation of the switching parameters in the associated functions and to enable reliable activation and/or deactivation of the optional functions with regard to temporal sequences.

In one preferred development, the changeover manager uses a message for forming fingerprints of a currently used switching parameter set and a newly received switching parameter set.

A "Message-Digest Algorithm 5, MD5" method or a CRC method, which can be used to uniquely identify the contents of a switching parameter set, comes into consideration for forming the fingerprints, for example.

The fingerprints are transmitted, together with an associated receipt date, to the central entity. This entity then selects, as a valid switching parameter set, that switching parameter set whose fingerprint is the same across all control devices and has the most recent receipt date, and transmits the decision to the control device of the rail vehicle or to the associated control devices.

In one preferred development, the optional function is activated and/or deactivated in a safe state of the rail vehicle, preferably at a standstill and/or in a predefined vehicle environment. When the control devices are restarted, the new switching parameter set is then loaded in order to make available the configured range of functions of the vehicle or control software.

In one preferred development, a traction vehicle driver of the rail vehicle receives a message indicating that the range of functions of the software has been modified and/or configured.

A veto right is preferably granted to the traction vehicle driver, so that the driver can accept or reject the software configuration.

A rejection decision is preferably obtained once and is then deemed to be a permanent rejection, that is to say a rejection decision is retained even if the control devices are restarted in future.

Alternatively, the decision by the traction vehicle driver is requested again each time the control devices of the vehicle are restarted.

In one preferred development, a list of the activated optional functions and of the associated parameters is displayed to a traction vehicle driver of the rail vehicle on a display.

It is not possible for the traction vehicle driver to influence the optional functions which have been set. This task is preferably the responsibility of the fleet management.

In one preferred development, a previous switching parameter set remains valid or active if not all control devices consistently adopt the new switching parameter set.

In one preferred development, a restart of the control devices of the control technology is initialized if a control device is replaced or a control device is removed from the group, in order to ensure the adoption of currently valid switching parameters.

The method according to the invention makes it possible for the sales department, the manufacturer and/or the fleet management of a rail vehicle to subsequently activate functions which are desired or required by the customer in vehicles that have already been delivered, without having to involve technical specialist departments.

The method according to the invention makes it possible for the sales department, the manufacturer and/or the fleet management of a rail vehicle to subsequently configure the control software in vehicles that have already been delivered in a predetermined framework and with a quick response.

By virtue of the method according to the invention, the software configuration can be carried out or is enabled either by means of service personnel in situ or using remote data transmission.

The software configuration can be reliably carried out both in terms of functional aspects and in terms of safety aspects by virtue of the method according to the invention.

The method according to the invention makes it possible to react to customer requirements considerably more quickly by setting predefined parameters in functions and activating functions that have already been approved.

The method according to the invention reduces costs since a software configuration can be carried out directly, that is to say without involving subsequent engineering services, and without subsequently validating the software or re-approving the software.

The method according to the invention at least reduces or completely avoids previously required non-regression tests in a test infrastructure required for this purpose.

The invention is explained, by way of example, in more detail below with reference to a drawing, in which:

DETAILED DESCRIPTION OF THE INVENTION

Figure 1:
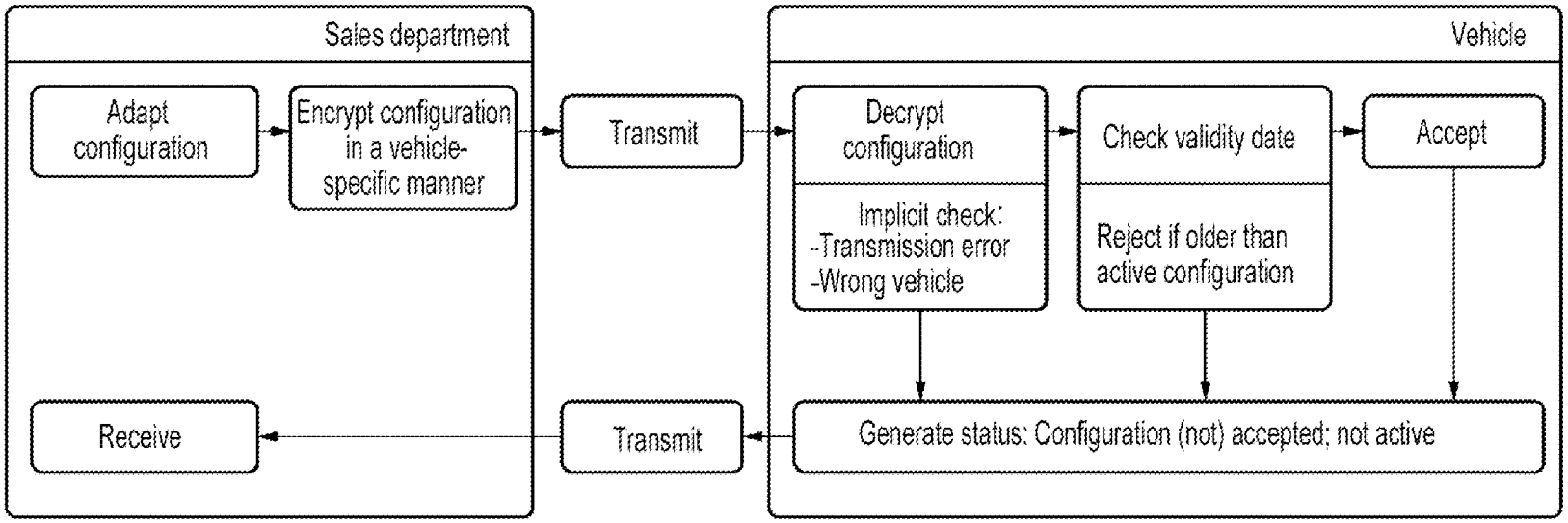
FIG. 1 shows a self-explanatory illustration of a software configuration formed by the sales department and its implementation by a vehicle or rail vehicle according to the present invention.
Figure 2:
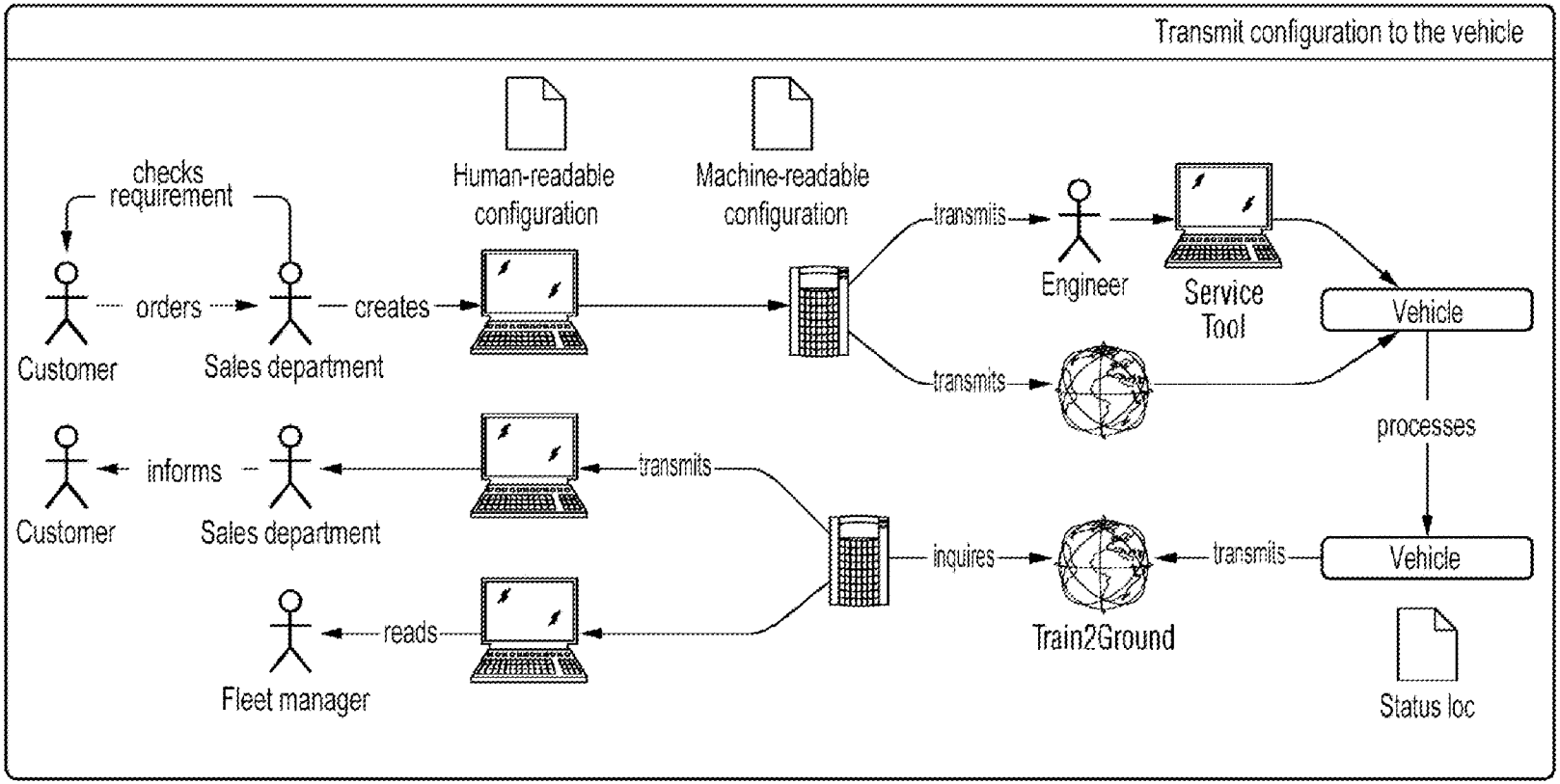
FIG. 2 shows a self-explanatory illustration of the interaction between customers, the sales department and the vehicle or rail vehicle according to the present invention.
Figure 3:
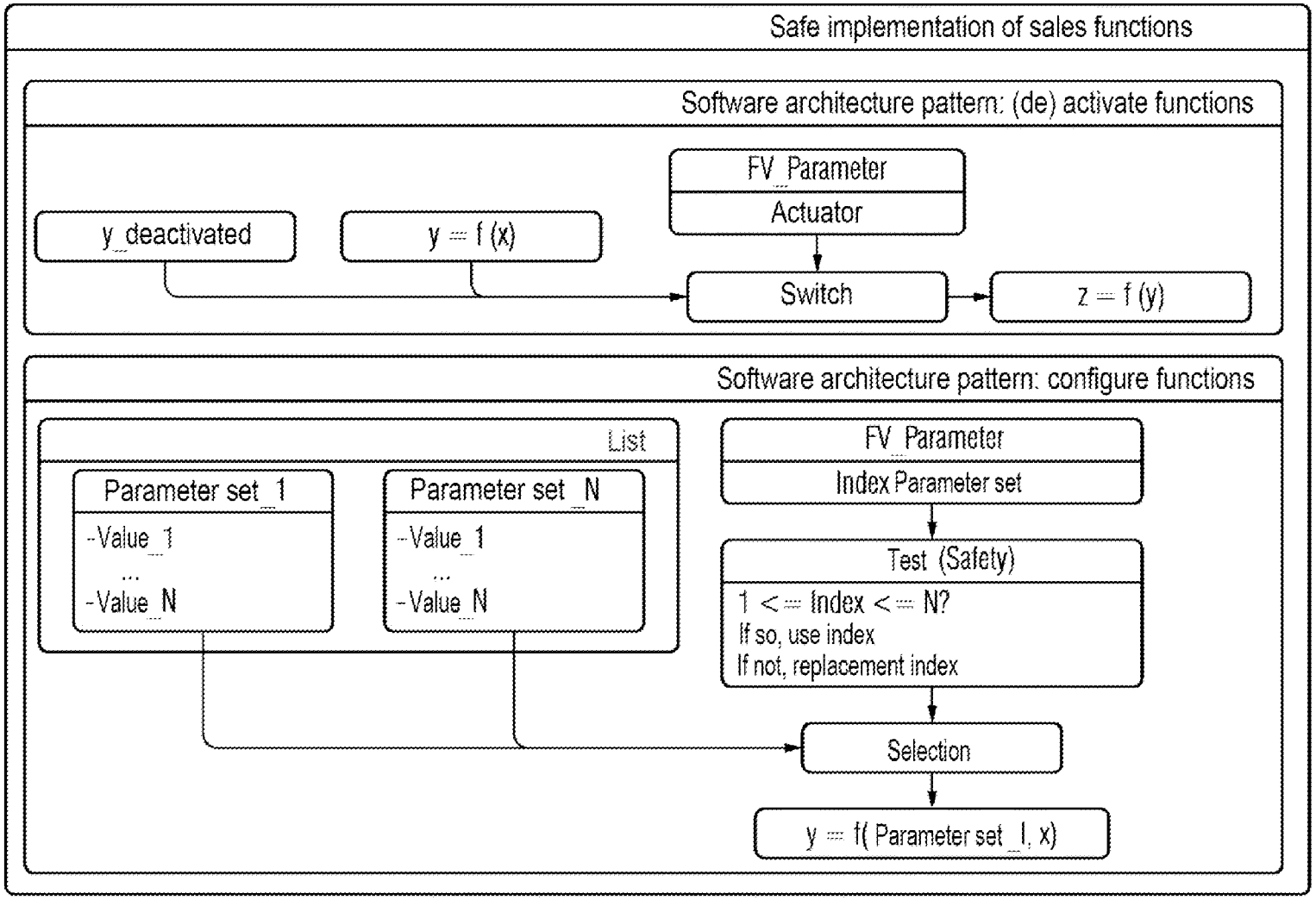
FIG. 3 shows a self-explanatory configuration of the activation and/or deactivation of an optional function according to the present invention.
Figure 4:
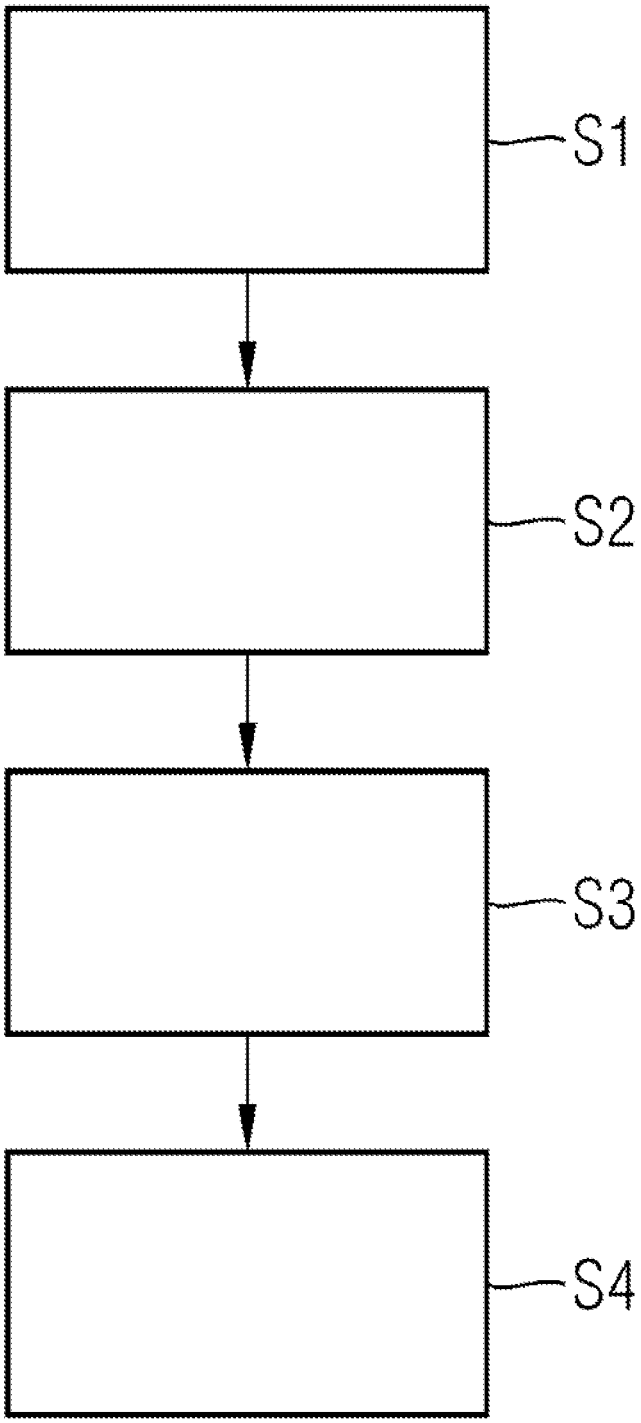
FIG. 4 shows an overall view of the present invention using a flowchart.

In a first step S1, basic functions which are needed for the basic operation of the rail vehicles are implemented in control software intended for a multiplicity of rail vehicles. Optional functions which are needed to implement a customer-specific requirements are implemented in the control software.

In a second step S2, the embodiments, combinations and functional sequences of the basic functions and the optional functions are tested, validated and approved before the control software is implemented in the rail vehicles by the manufacturer or by appointed entities.

In a third step S3, the basic functions and the optional functions are implemented as control software in the rail vehicles.

In a fourth step S4, at least one optional function is activated and/or deactivated in a selected rail vehicle using a switching parameter individually assigned to the optional function.

The required switching parameter is created outside the rail vehicle on the basis of customer requirements and is subsequently transmitted to the selected rail vehicle.

A predetermined usage period is assigned to the activated optional function.

The optional function is activated and/or deactivated in a rail vehicle which is in operation.

The switching parameter is determined using software-supported tools which allow only a permissible switching parameter selection for corresponding functions.

The switching parameters are stored individually or in the form of a file which can be directly processed by control devices of the selected rail vehicle.

The switching parameters are encrypted, with the result that decryption can be carried out solely by the selected rail vehicle.

The switching parameters are transmitted, via a communication channel, to a service engineer who updates the control software in the selected rail vehicle, or are transmitted directly to the selected rail vehicle, wherein its control devices automatically implement them in the control software.

During activation, the control devices of the rail vehicle inquire, at a central entity of the rail vehicle or at a landside control station, whether there are new switching parameters for the associated rail vehicle.

The inquiry is coordinated with the aid of a changeover manager in order to enable coordinated activation and/or deactivation of optional functions or of the switching parameters in associated optional functions.

The optional function is activated and/or deactivated in a safe state of the rail vehicle, preferably at a standstill or in a predefined vehicle environment.

A veto right is granted to the traction vehicle driver of the rail vehicle in order to reject a control software configuration with respect to the optional function.

Permanent activation of an optional function is adopted into an original state of the control software, which is stored on the rail vehicle for the purpose of protecting the latter.

A warning message is displayed to a rail vehicle operator or to a rail vehicle fleet manager or to a rail vehicle manufacturer before expiry of the usage period in order to alert them to the imminent expiry of the usage period.

The warning message for an optional function causes the formation of identical warning messages for further optional functions.

The invention claimed is:

1. A method for configuring control software in a rail vehicle, which comprises the steps of:

implementing basic functions which are needed for basic operation of the rail vehicle in the control software intended for a plurality of rail vehicles;

implementing optional functions which are needed to implement a plurality of customer-specific requirements profiles in the control software;

testing, validating and approving embodiments, combinations and functional sequences of the basic functions and the optional functions before the control software is implemented in the rail vehicles;

subsequently implementing the basic functions and the optional functions as the control software in the rail vehicles;

activating or deactivating, in a selected rail vehicle, at least one of the optional functions using a switching parameter individually assigned to the at least one optional function;

creating the switching parameter required for this purpose outside the rail vehicle on a basis of a special customer-specific requirements profile and is subsequently transmitted to the selected rail vehicle;

selecting and determining contents of assigned switching parameters by a manufacturer of the rail vehicle in order to enable fleet management in which selected one of the rail vehicles are adapted to specific tasks according to a specification of the special customer-specific requirements profile;

assigning a predetermined usage period to an activated optional function;

retrieving a list of all the optional functions, together with an assigned predetermined usage period of the selected rail vehicle in a remotely controlled manner using a web server; and displaying a warning message to the manufacturer of the rail vehicle before expiry of the assigned predetermined usage period in order to alert the manufacturer of the rail vehicle to an imminent expiry of the assigned predetermined usage period of an optional function, wherein the warning message for the optional function causes a formation of identical warning messages for further ones of the optional functions in order to prevent foreseeable deactivation of the optional function having undesirable effects on other said optional functions.

2. The method according to claim 1, which further comprises activating and deactivating the optional function in the rail vehicle which is in operation.

3. The method according to claim 1, which further comprises determining the switching parameter using software-supported tools which allow only a permissible switching parameter selection for corresponding functions.

4. The method according to claim 1, which further comprises storing switching parameters individually or in a form of a file which can be directly processed by control devices of the selected rail vehicle.

5. The method according to claim 4, which further comprises encrypting the switching parameters, with a result that decryption can be carried out solely by the selected rail vehicle.

6. The method according to claim 1, which further comprises transmitting switching parameters via a communication channel and:

via an interface to a service engineer who updates the control software in the selected rail vehicle; or are transmitted directly to the selected rail vehicle, wherein the selected rail vehicle control devices automatically implement the switching parameters in the control software.

7. The method according to claim 1, wherein control devices of the rail vehicle, during activation, inquire, at a central entity of the rail vehicle or at a landside control station, whether there are new switching parameters for an associated rail vehicle of the rail vehicles.

8. The method according to claim 7, wherein an inquiry is coordinated with an aid of a changeover manager in order to enable coordinated activation and/or deactivation of the optional functions or of switching parameters in associated ones of the optional functions.

9. The method according to claim 1, which further comprises activating and/or deactivating the optional function in a safe state of the rail vehicle.

10. The method according to claim 1, which further comprises granting a veto right to a traction vehicle driver of the rail vehicle in order to reject a control software configuration with respect to the optional function.

11. The method according to claim 1, wherein a permanent activation of the optional function is adopted into an original state of the control software, which is stored on the rail vehicle for a purpose of protecting the latter.

12. The method according to claim 1, wherein the warning message for the optional function causes a formation of identical warning messages for further ones of the optional functions.

13. A rail vehicle, comprising:

control software, wherein:

said control software, which is intended for a plurality of rail vehicles, has basic functions which are intended for a basic operation of the rail vehicle;

said control software has optional functions which are intended to implement a plurality of customer-specific requirements profiles, embodiments, combinations and functional sequences of the basic functions and the optional functions are tested, validated and approved before said control software is implemented in the rail vehicle;

at least one of the optional functions can be activated and/or deactivated using a switching parameter individually assigned to the at least one optional function;

the switching parameter required for this purpose can be created outside the rail vehicle on a basis of a special customer-specific requirements profile and can subsequently be transmitted to a selected rail vehicle for a purpose of configuring said control software;

contents of assigned switching parameters are selected and determined by a manufacturer of the rail vehicle in order to enable fleet management in which selected rail vehicles can be adapted to specific tasks according to a specification of the customer-specific requirements profile;

a predetermined usage period is assigned to an activated optional function of the optional functions;

a list of all the optional functions, together with an assigned usage period of the selected rail vehicle, can be retrieved in a remotely controlled manner using a web server;

a warning message can be displayed to the manufacturer before expiry of the assigned usage period in order to alert the manufacturer to an imminent expiry of the assigned usage period of the optional function; and the warning message for the optional function causes a formation of identical warning messages for further ones of the optional functions in order to prevent foreseeable deactivation of the optional function having undesirable effects on other ones of the optional functions.

14. The rail vehicle according to claim 13, wherein the optional function can be activated and/or deactivated in the rail vehicle which is in operation.

15. The rail vehicle according to claim 13, wherein the switching parameter can be determined using software-supported tools which allow only a permissible switching parameter selection for corresponding functions.

16. The rail vehicle according to claim 13, further comprising control devices, wherein the switching parameters are stored individually or in a form of a file which can be directly processed by said control devices of the selected rail vehicle.

17. The rail vehicle according to claim 16, wherein the switching parameters are encrypted, with a result that decryption can be carried out solely by the selected rail vehicle.

18. The rail vehicle according to claim 16, wherein the switching parameters can be transmitted via a communication channel and:

via an interface to a service engineer who updates the control software in the selected rail vehicle; or be transmitted directly to the selected rail vehicle, wherein said control devices of the selected rail vehicle automatically implement the switching parameters in the control software.

19. The rail vehicle according to claim 13, further comprising control devices which are switched during activation in such a manner that said control devices inquire, at a central entity of the rail vehicle or at a landside control station, whether there are new switching parameters for an associated rail vehicle.

20. The rail vehicle according to claim 13, wherein permanent activation of the optional function is adopted into an original state of said control software and this is stored on the rail vehicle for a purpose of protecting the latter.

* * * * *